US006154521A

United States Patent [19]

Campbell

[11] Patent Number: 6,154,521

[45] Date of Patent: Nov. 28, 2000

[54] GYRATING ANODE X-RAY TUBE

[75] Inventor: Robert B. Campbell, Naperville, Ill.

[73] Assignee: Picker International, Inc., Highland Heights, Ohio

[21] Appl. No.: 09/179,018

[22] Filed: Oct. 26, 1998

[51] Int. Cl.[7] ..... H01J 35/12

[52] U.S. Cl. ..... 378/125; 378/126; 378/130; 378/131; 378/141

[58] Field of Search ..... 378/125, 126, 378/130, 131, 141

[56] References Cited

U.S. PATENT DOCUMENTS

| | | | |
|---|---|---|---|
| 2,133,606 | 10/1938 | Du Mond | 378/126 |
| 2,922,904 | 1/1960 | Zunick | 378/43 |
| 3,737,698 | 6/1973 | Carter | 378/124 |
| 3,794,872 | 2/1974 | Haas et al. | 378/141 |
| 3,836,805 | 9/1974 | Kok | 378/126 |
| 4,107,563 | 8/1978 | Oddell | 378/126 |
| 4,150,293 | 4/1979 | Franke | 378/9 |
| 4,384,359 | 5/1983 | Franke | 378/9 |
| 4,949,369 | 8/1990 | Bittl | 378/130 |
| 5,018,181 | 5/1991 | Iversen et al. | 378/144 |
| 5,222,114 | 6/1993 | Kamata et al. | 378/143 |
| 5,604,778 | 2/1997 | Polacin et al. | 378/9 |
| 5,737,387 | 4/1998 | Smither | 378/130 |

*Primary Examiner*—David P. Porta
*Assistant Examiner*—Allen C Ho
*Attorney, Agent, or Firm*—Fay, Sharpe, Fagan, Minnich & McKee, LLP

[57] ABSTRACT

An x-ray tube (10) includes an anode (14) connected to a mechanical drive (36). The mechanical drive oscillates the anode in a gyrating motion relative to a body of the x-ray tube. The mechanical drive is operatively connected to the anode via a bellows assembly (16) and is capable of rocking the anode in two axes simultaneously. The preferred anode is shaped in a shperical section (28) providing a fixed focal distance between the anode and a cathode (20) regardless of relative position of the anode within the body. An electron shield (40) is disposed between the cathode and the anode and has an opening along a preferred path for electron travel. Improved heat exchange is provided by applying a heat transfer agent to an obverse side of the anode which is preferably located outside of a vacuum envelope (18) defined by the x-ray tube body, the anode, and the bellows.

19 Claims, 3 Drawing Sheets

GYRATING ANODE X-RAY TUBE

BACKGROUND OF THE INVENTION

The present invention relates to the high power x-ray tube arts. It finds particular application in conjunction with x-ray tubes for CT scanners and will be described with particular reference thereto. It is appreciated, however, that the invention will also find application in conjunction with other types of vacuum tubes employing high power cathodes and temperature sensitive anodes.

In early x-ray tubes, electrons from a cathode filament were drawn at a high voltage to a stationary target anode. The impact of the electrons caused the generation of x-rays as well as significant thermal energy. As higher power x-ray tubes were developed, the thermal energy became so large that extended use tended to damage the anode.

Today, one of the principal ways to distribute the thermal loading and reduce anode damage is to use a rotating anode. The electron beam is focused near a peripheral edge of an anode disk. As the anode rotates, the portion of the anode where x-rays are generated moves along an annular path. Each spot along the annular footprint is heated to a very high temperature as it passes under the electron beam and cools as it rotates around before returning for the generation of additional x-rays. However, if the path of travel is too short, the target area on the anode can still contain sufficient thermal energy that the additional thermal energy from the electron beam can still cause thermal damage to the anode surface. Thus, as higher power x-ray tubes are developed, the diameter and the mass of the anode continues to grow. Unfortunately, this growth has undesirable side effects, such as increasing x-ray tube cost, greater tube size, more massive tube mounting assemblies, and the like. These problems are particularly acute in CT machines where space is very tight.

An additional cost, heretofore unrecognized, is incurred by the inefficient use of the anode surface area. Recall that the path etched on a rotating anode by the electron beam is a linear ring. This results in a very small relative portion of the anode surface ever being struck by electrons for the generation of x-rays, essentially using the large remainder only for absorption of thermal energy.

Other costs are incurred from the use of less efficient heat exchanging methods. In today's rotating anode x-ray tubes, cooling is difficult. Recall that a bearing mounted rotating anode is located in a vacuum and that the impact of electrons causes significant thermal energy in addition to x-rays. In order to protect the anode, various methods to reduce or dissipate the thermal energy have been used. There are three generally accepted ways to transfer heat energy; namely, convection, conduction and radiation.

Concerning present x-rays tubes, two of these methods lack efficacy. Convection is ineffective due to the vacuum in which the anode is typically located. Conduction is limited due to the bearings on which rotating anodes are mounted. In a rotating anode x-ray tube, the conduction path is typically through the bearing on which the anode is mounted. Not only does the passage of heat through a bearing degrade it, but the conduction is slower than the rate at which energy is added. The circulation of cooling fluid through the bearing would cause fluid and vacuum sealing difficulties. Thus, in rotating anode x-ray tubes, radiation heat exchange is the primary way of transferring heat energy to oil circulating around the exterior of the vacuum envelope.

The present invention contemplates a new, improved x-ray tube configuration and method of x-ray generation which overcomes the above difficulties and others.

BRIEF SUMMARY OF THE INVENTION

In accordance with the present invention, an x-ray tube includes a body defining a vacuum envelope within which a cathode is disposed. A spherical anode target section is movably mounted to the body. A mechanical drive is connected to the anode target section and the body to drive the anode target with a gyrating motion relative to the body.

In accordance with another aspect of the present invention, the body includes a rigid cup shaped body portion and a bellows connected between the cup shaped body portion and the anode target section.

In accordance with another aspect of the present invention, the bellows extends annularly around the cup shaped portion and a conical section extends between the bellows and the spherical anode target section.

In accordance with another aspect of the present invention, the mechanical drive rocks the spherical anode target section along two axes such that the spherical anode target section gyrates along a sphere of a fixed radius.

In accordance with another aspect of the present invention, the x-ray tube also includes an electron shield disposed across the vacuum envelope having an opening to permit electrons to follow a desired path to strike the anode.

In accordance with yet another aspect of the present invention, an x-ray tube includes a cathode fixedly mounted in an insulating housing for generating a beam of electrons which travel along a pre-selected trajectory. An anode is movably mounted to the housing such that a multiplicity of points on a target portion of the anode are movable to intersect the electron trajectory at a preselected distance from the cathode. An oscillating drive oscillates the anode back and forth to bring the plurality of points on the anode target surface into intersection with the trajectory at the preselected distance.

In accordance with a more limited aspect of the present invention, the oscillating drive includes a first drive for oscillating the anode along a first direction and a second drive for oscillating the anode along a second direction. The drives interact such that the points of intersection between the trajectory and the anode target surface follow a spirographic pattern.

In accordance with another more limited aspect, the anode includes a spherical target section and a conical rearward extension which extends from the target surface away from the cathode.

In accordance with another more limited aspect of the present invention, a rear end of the conical extension lies in a plane which intersects a geometric center of the spherical target surface.

In accordance with yet another aspect of the present invention, a method of generating x-rays includes sending a beam of electrons through an evacuated region along a preselected trajectory extending between an electron source and an anode target surface. The anode target surface is disposed a preselected distance along the trajectory from the electron source. The target is concurrently heated with the electron beam generating heat and radiation, and oscillated to ensure different portions of the target are acted upon by the electron beam.

In accordance with a more limited aspect of the present invention, the method further includes flowing a cooling liquid along an obverse side of the anode to remove the heat generated by the interaction with the electron beam.

One advantage of the present invention is that x-ray tube anodes can be smaller without a reduction in radiation output.

Another advantage of the present invention resides in decreased mechanical complexity.

Another advantage of the present invention resides in improved heat exchange efficiency.

Another advantage of the present invention is reduced heat exchange requirements without a loss of output capacity.

Another advantage of the present invention is improved uniformity of the electric field and spatial positioning of the focal spot.

Yet another advantage of the present invention is substantial masking of off focal spot radiation.

Other benefits and advantages of the present invention will become apparent to those skilled in the art upon a reading and understanding of the preferred embodiments.

BRIEF DESCRIPTION OF THE DRAWINGS

The invention may take physical form in certain parts and arrangements of parts and in various steps and arrangements of steps. The drawings are only for purposes of illustrating the preferred embodiments and are not to be construed as limiting the invention.

DETAILED DESCRIPTION OF THE PREFERRED EMBODIMENT

Figure 1:
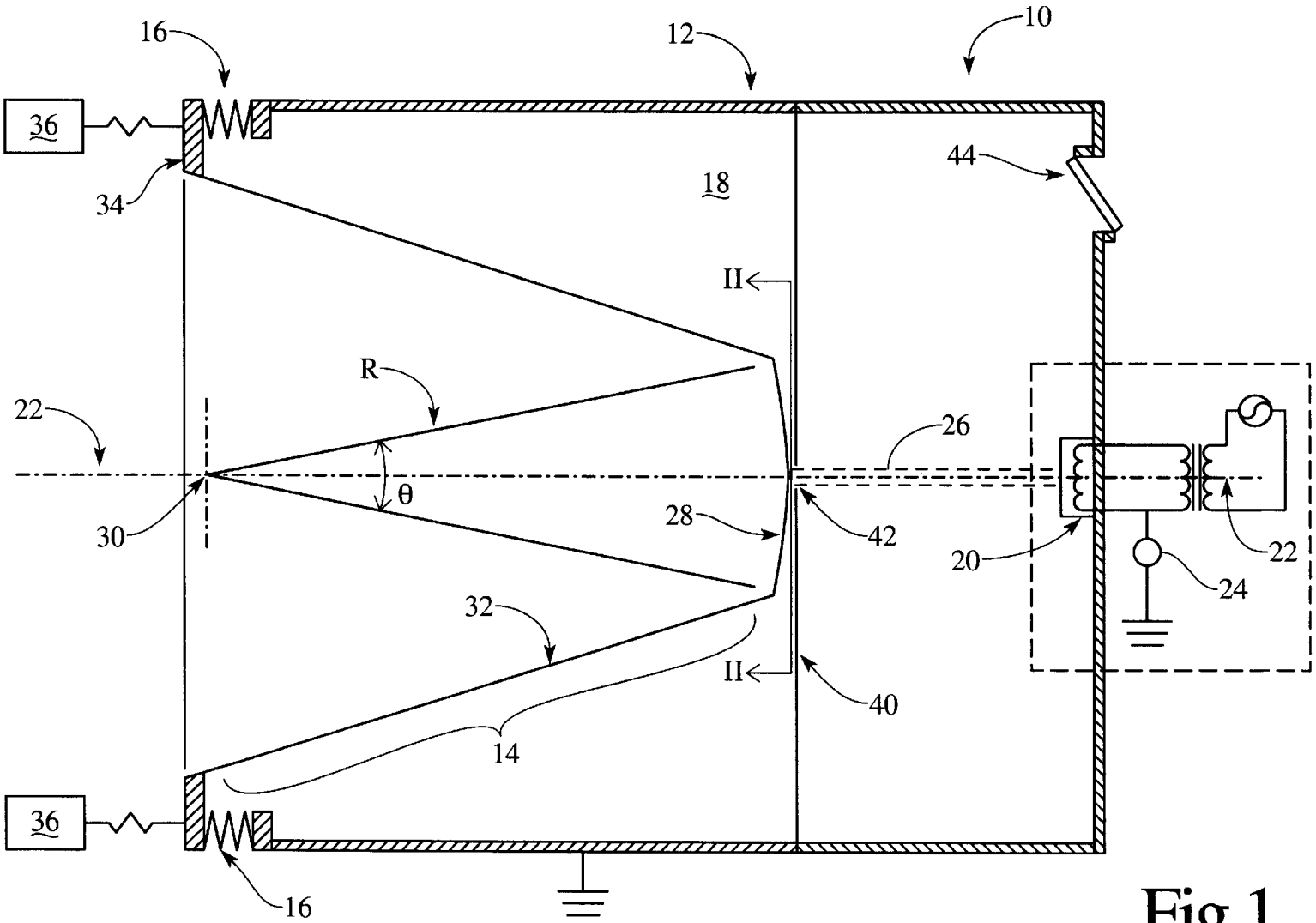
FIG. 1 illustrates a cross-sectional view of a gyrating anode x-ray tube in accordance with the present invention.

With reference to FIG. 1, the gyrating anode x-ray tube 10 includes a body configured as an insulating cylindrical, cup-shaped portion 12 and a movably mounted cone shaped anode 14. The insulating cup-shaped portion 12 and the movably mounted cone shaped anode 14 are connected by a flexible bellows 16 to define a vacuum envelope 18. A cathode assembly 20 is mounted to the insulating portion inside the vacuum envelope generally along a centerline 22 of the tube 10. A high voltage source 24 applies a high voltage across the cathode and the anode. This voltage propels electrons, generally designated 26, emitted from the cathode 20 toward a spherical target section 28 of the anode.

The spherical section is defined by a fixed radius R about a pivot or center point 30 on the centerline axis 22. In other words, the cross-section of the spherical section 28 seen in FIG. 1 is defined by an arc, having an angle θ and a radius R.

Still referring to FIG. 1, the spherical target section 28 of the anode 14 is connected with a target cone 32, which is connected to a rear plane ring 34. The flexible bellows mechanism 16 movably connects the rear plane ring 34 to the insulating cup shaped body portion 12. A plurality of mechanical actuators 36, preferably a pair along each of two axes perpendicular to the centerline, are attached to the rear plane ring to generate controlled gyrating movement of the anode target surface segment 28. The mechanical actuators 36 oscillate the anode with respect to each of the two axes such that the spheric target segment 28 is constrained to move on the surface of a sphere of radius R. The spherical target section and gyrating movement constrained to the sphere provides a constant focal distance from the cathode 20 to the spheric target segment 28 regardless of the position of the anode structure 14 relative to the center line 22.

Figure 2:
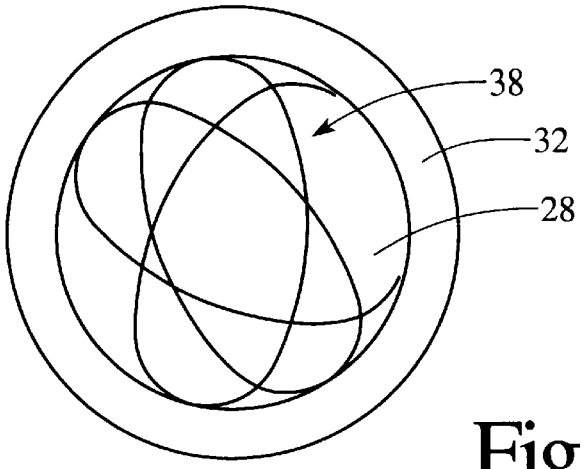
FIG. 2 is a transverse view along II—II illustrating the target cone of the tube of FIG. 1 bearing a partial trace of a scan pattern in accordance with the present invention.

Now cross-referencing FIG. 2, preferably each pair of actuators 36 move cyclically with a phase off-set such that the electron beam 26 traverses a spirographic path 38 along the spherical target section 28. It is to be understood that this spirograph pattern is the presently preferred path but that other continuous paths may be traced on the target section 28, including circular, FIG. 8, spiral or other scan paths.

Between the cathode and the anode, an electron shield 40 is positioned to help focus the electron beam. The shield 40 defines an aperture around the electron beam adjacent a focal spot 42. The shield optionally has a negative electrical bias for actively focusing the electron beam. The electron shield 40 blocks electrons from impacting other portions of the anode and causing off-focal radiation. On-axis electrons 26 pass through the shield 40 and strike the anode 28 generating x-rays and heat. The x-rays which emanate omnidirectionally from the focal spot are constrained by the electron shield to a cone which encompasses an x-ray beam exit window 44.

Recall that the interior of the x-ray tube 10 defines a vacuum envelope 18. It should be noted that the target cone 32 and the spherical section 28 define part of the vacuum envelope 18 and that the vacuum envelope 18 is continuous through the focal spot 42. Having the anode structure 14 define part of the vacuum envelope 18 provides access to the obverse side of the spherical target section 28. Typically, the x-ray tube is mounted in a cooling oil filled outer housing (not shown). The oil is circulated through the housing, over the x-ray tube and out of the housing to a heat exchanger. The present configuration enables the cooling oil to flow directly over the back of the anode target to remove thermal energy.

Figure 3:
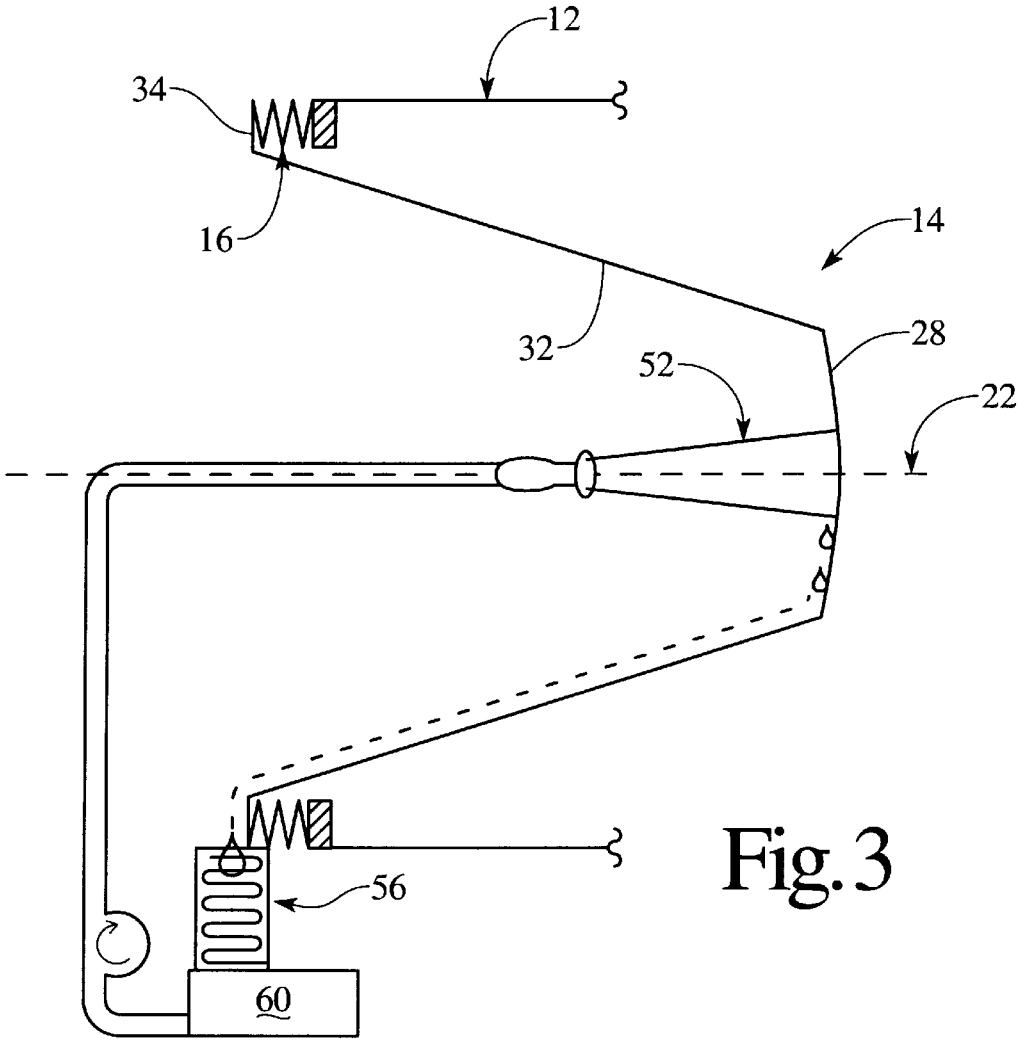
FIG. 3 shows an alternate embodiment for the tube of FIG. 1.

Referring now to FIG. 3, access to the obverse side of the spherical section 28 allows heat transfer to be accomplished by more efficient conduction. For example, in FIG. 3, a heat transfer agent 52 (oil, water, or the like) is sprayed onto the obverse side of the spherical section 28. Also, due to the predictable path of electron travel through the tube 10, i.e. along the centerline 22, the heat transfer agent 52 correspondingly is directed primarily along the centerline 22. This advantage provides conduction at the spot opposite of where the electron beam is striking the spherical section 28 regardless of the relative position of the anode structure 14 within the body 12.

Figure 4:
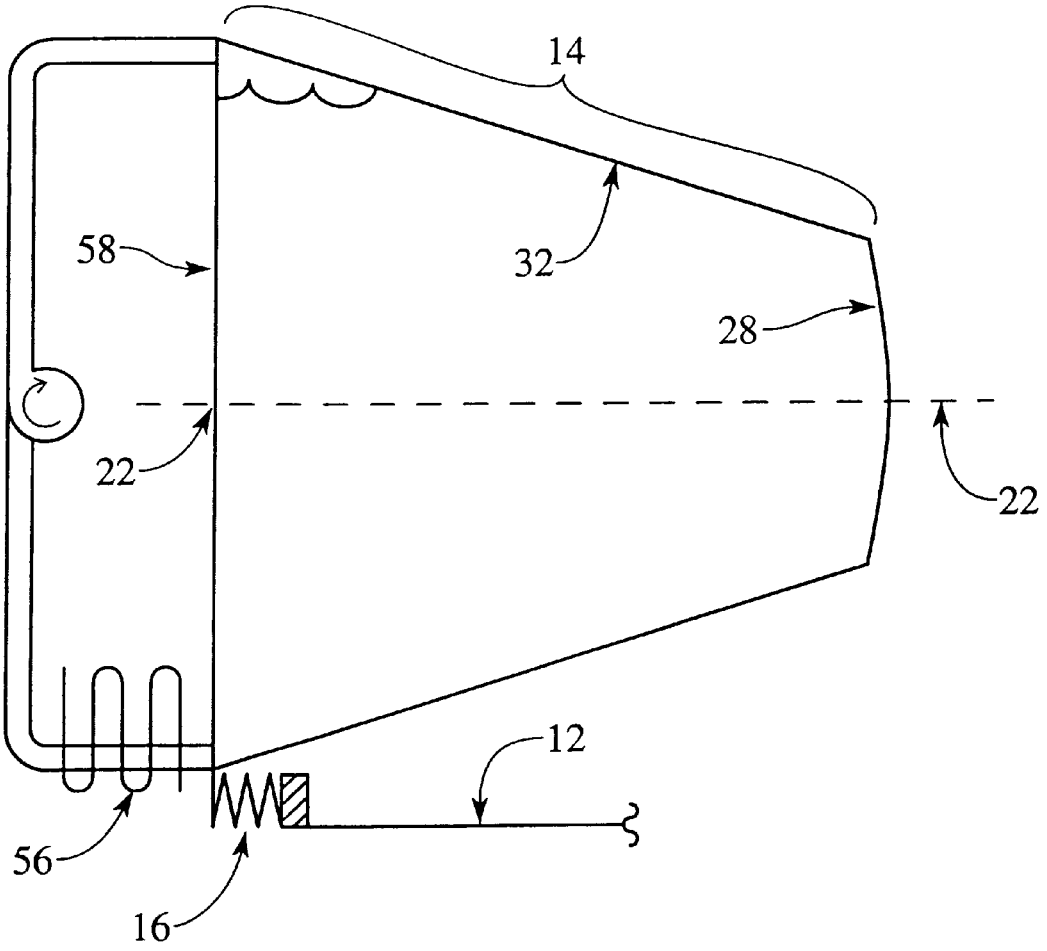
FIG. 4 illustrates another embodiment for the tube of FIG. 1.

With reference to FIG. 4, the anode structure 14 can also combine with a rear plane plate 58 to define an enclosed volume which the heat transfer agent fills. In the alternative embodiment of FIG. 3, the oil 52 is sprayed onto the back side of the spherical section 28, captured, cycled through a heat exchanger 56 and returned to an oil reservoir 60. In the alternative embodiment of FIG. 4, the oil is again circulated through a heat exchanger 56, but the anode itself is able to function as the reservoir.

The invention has been described with reference to the preferred embodiments. Potential modifications and alterations will occur to others upon a reading and understanding of the specification. It is our intention to include all such modifications and alterations insofar as they come within the scope of the appended claims, or the equivalents thereof.

Having thus described our invention, we now claim:

1. An x-ray tube comprising:

a rigid cup shaped body portion defining an opening into an interior volume, having a cathode disposed within the volume along a central axis of the cup shaped body portion;

an anode disposed opposite the cathode; and, a bellows connecting the cup shaped body portion and a conical section, said conical section extending between the bellows and the anode.

2. A method of generating x-rays comprising:

focusing a beam of electrons at a particular location on a spherical segment anode;

heating the spherical segment anode with the beam of electrons to generate heat and radiation;

oscillating the spherical segment anode under the beam of electrons; and, spraying a fluid onto the spherical segment anode opposite the particular location.

3. An x-ray tube including:

a body defining a vacuum envelope;

a cathode disposed within the vacuum envelope;

an anode target section movably mounted to the body;

a high voltage source which applies a high voltage across the cathode and the anode target section;

a bellows connected between the body and the anode target section; and, a conical section extending between the bellows and the anode target section.

4. The x-ray tube as set forth in claim 3 wherein the mechanical drive rocks the anode target section along two axes such that the anode target section gyrates along a sphere of determined radius.

5. The x-ray tube as set forth in claim 3 further including:

an electron shield disposed across the vacuum envelope between the cathode and the anode, the electron shield having an opening to permit electrons to follow a preselected path to strike the anode target section.

6. The x-ray tube as set forth in claim 3 further in claim 1 further including:

a heat transfer agent that flows along and in contact with a reverse surface of the anode target section.

7. An x-ray tube comprising:

a housing which defines an x-ray exit window;

a cathode mounted in the housing, which generates a beam of electrons along a trajectory;

an anode which is moveably mounted relative to the housing, the anode having an enlarged target surface, which target surface intersects the electron beam trajectory, the anode being moveably mounted relative to the housing such that a multiplicity of points on the target surface are moveable to intersect the electron beam trajectory; and, a first driver for oscillating the anode along a first direction and a second driver for oscillating the anode along a second direction such that points of intersection between the trajectory and the anode target surface follow a two-dimensional pattern.

8. The x-ray tube as set forth in claim 7, further comprising:

a heat transfer agent in selective thermal contact with a side of the anode opposite the point where the electron beam trajectory intersects the target surface.

9. The x-ray tube as set forth in claim 7 wherein the anode target surface includes a spherical surface segment of a preselected radius, the anode being mounted to the housing such that the target spherical surface segment is constrained to move along the surface of a sphere of the preselected radius.

10. An x-ray tube comprising:

a cathode mounted to a housing, the cathode generating a beam of electrons which travel along a trajectory;

an anode which is movably mounted relative to the housing, the anode having an enlarged target surface, a point of which target surface intersects the electron beam trajectory, the surface including a spherical surface segment of a preselected radius, the anode being mounted to the housing such that the target spherical surface segment is constrained to move along the surface of a sphere of the preselected radius; and, a conical rearward extension extending from the target surface away from the cathode.

11. The x-ray tube as set forth in claim 10 further including an annular bellows connected between the anode cone and the housing for moveably connecting the anode to the housing.

12. The x-ray tube as set forth in claim 10 wherein a rear end of the cone lies in a plane which intersects a geometric center of the spherical surface segment.

13. The x-ray tube as set forth in claim 12 further including mechanical drives for rocking the plane of the terminal end of the cone about the geometric center of the spherical target section.

14. A method of generating x-rays, the method comprising:

sending a beam of electrons along a preselected trajectory extending between an electron source and an anode target surface which lies along a surface of a sphere, and is disposed a preselected distance along the trajectory from the electron source;

heating the target with the electron beam to generate heat and radiation; and, oscillating the anode target surface across the trajectory such that different portions of the anode target surface intersect the trajectory and are acted upon by the electron beam to generate heat and radiation.

15. The method of generating x-rays as set forth in claim 14 wherein the anode target surface oscillates with a phase offset in two dimensions such that the point of intersection between the trajectory and the anode target surface follows a spirographic pattern.

16. The method of generating x-rays as set forth in claim 14 wherein the oscillating step includes:

rocking the anode target surface back and forth in at least one direction along the surface of the sphere.

17. The method of generating x-rays as set forth in claim 16 wherein the anode target surface is oscillated relative to at least two axes.

18. The method of generating x-rays as set forth in claim 14 further including:

applying a cooling fluid to an obverse side of the anode target surface to remove heat generated by the interaction with the electron beam.

19. The method of generating x-rays as set forth in claim 14 further including:

focusing the electron beam along the preselected trajectory.

* * * * *